US007780095B2

(12) United States Patent
Babaev

(10) Patent No.: US 7,780,095 B2
(45) **Date of Patent: *Aug. 24, 2010**

(54) ULTRASOUND PUMPING APPARATUS

(75) Inventor: Eilaz Babaev, Minnetonka, MN (US)

(73) Assignee: Bacoustics, LLC, Minnetonka, MN (US)

( * ) Notice: Subject to any disclaimer, the term of this patent is extended or adjusted under 35 U.S.C. 154(b) by 421 days.

This patent is subject to a terminal disclaimer.

(21) Appl. No.: 11/777,955

(22) Filed: Jul. 13, 2007

(65) Prior Publication Data

US 2009/0014551 A1 Jan. 15, 2009

(51) Int. Cl.
*B05B 1/08* (2006.01)
*B05B 7/04* (2006.01)
*B05B 1/00* (2006.01)

(52) U.S. Cl. ..... 239/102.2; 239/102.1; 239/427; 239/427.3; 239/432; 239/434; 239/589; 239/601

(58) Field of Classification Search ..... 239/4, 239/102.1, 102.2, 398, 427–428, 429–434, 239/589, 601; 73/632, 644; 137/827, 828
See application file for complete search history.

(56) References Cited

U.S. PATENT DOCUMENTS

| | | | |
|---|---|---|---|
| 3,523,906 | A | 8/1970 | Vrancken et al. |
| 3,561,444 | A | 2/1971 | Boucher |
| 3,663,288 | A | 5/1972 | Miller |
| 3,779,792 | A | 12/1973 | Stoy et al. |
| 3,861,852 | A | 1/1975 | Berger |
| 3,924,335 | A | 12/1975 | Balamuth et al. |
| 3,970,250 | A | 7/1976 | Drews |
| 4,047,957 | A | 9/1977 | De Winter et al. |
| 4,100,309 | A | 7/1978 | Micklus et al. |
| 4,119,094 | A | 10/1978 | Micklus et al. |
| 4,153,201 | A | 5/1979 | Berger et al. |
| 4,168,447 | A | 9/1979 | Bussiere et al. |
| 4,169,984 | A | 10/1979 | Parisi |
| 4,263,188 | A | 4/1981 | Hampton et al. |
| 4,271,705 | A | 6/1981 | Crostack |
| 4,301,093 | A | 11/1981 | Eck |
| 4,301,968 | A | 11/1981 | Berger et al. |
| 4,306,998 | A | 12/1981 | Wenzel et al. |
| 4,309,989 | A | 1/1982 | Fahim |
| 4,319,155 | A | 3/1982 | Nakai et al. |
| 4,373,009 | A | 2/1983 | Winn |
| 4,387,024 | A | 6/1983 | Kurihara et al. |
| 4,389,330 | A | 6/1983 | Tice et al. |

(Continued)

FOREIGN PATENT DOCUMENTS

| | | | |
|---|---|---|---|
| EP | 0416106 | A1 | 3/1991 |

*Primary Examiner*—Darren W Gorman

(57) ABSTRACT

The present invention relates to an apparatus utilizing ultrasonic vibrations to force movement of protrusions to spray a fluid. The apparatus includes a horn with an internal chamber. Within the internal chamber of the horn are protrusions extending from a wall of the chamber. When the horn is vibrated, a fluid is expelled from the horn by the oscillation of the protrusions. Fluid to be expelled from the horn enters the internal chamber of the horn through at least one channel passing through a wall of the horn and leading into the chamber. After passing through the horn's internal chamber, the fluid exits the horn by passing through a channel originating in the front wall of the chamber and ending at the horn's radiation surface. A transducer may be connected to the horn's proximal end to generate ultrasonic vibrations throughout the length of the horn.

23 Claims, 6 Drawing Sheets

U.S. PATENT DOCUMENTS

| | | | | |
|---|---|---|---|---|
| 4,391,797 | A | | 7/1983 | Folkman et al. |
| 4,402,458 | A | | 9/1983 | Lierke et al. |
| 4,459,317 | A | | 7/1984 | Lambert |
| 4,469,974 | A | | 9/1984 | Speranza |
| 4,474,326 | A | | 10/1984 | Takahashi |
| 4,483,571 | A | | 11/1984 | Mishiro |
| 4,487,808 | A | | 12/1984 | Lambert |
| 4,492,622 | A | | 1/1985 | Kuypers |
| 4,536,179 | A | | 8/1985 | Anderson et al. |
| 4,541,564 | A | * | 9/1985 | Berger et al. ..... 239/102.2 |
| 4,548,844 | A | | 10/1985 | Podell et al. |
| 4,582,654 | A | | 4/1986 | Karnicky et al. |
| 4,596,220 | A | | 6/1986 | Oosuga et al. |
| 4,642,267 | A | | 2/1987 | Creasy et al. |
| 4,646,967 | A | | 3/1987 | Geithman |
| 4,659,014 | A | | 4/1987 | Soth et al. |
| 4,666,437 | A | | 5/1987 | Lambert |
| 4,675,361 | A | | 6/1987 | Ward, Jr. |
| 4,684,328 | A | | 8/1987 | Murphy |
| 4,686,406 | A | | 8/1987 | Meitzler |
| 4,692,352 | A | | 9/1987 | Huddleston |
| 4,705,709 | A | | 11/1987 | Vailancourt |
| 4,715,353 | A | | 12/1987 | Koike et al. |
| 4,721,117 | A | | 1/1988 | Mar et al. |
| 4,726,525 | A | | 2/1988 | Yonekawa et al. |
| 4,732,322 | A | | 3/1988 | Gaysert et al. |
| 4,734,092 | A | | 3/1988 | Millerd |
| 4,748,986 | A | | 6/1988 | Morrison et al. |
| 4,764,021 | A | | 8/1988 | Eppes |
| 4,768,507 | A | | 9/1988 | Fischell et al. |
| 4,770,664 | A | | 9/1988 | Gogolewski |
| 4,793,339 | A | | 12/1988 | Matsumoto et al. |
| 4,795,458 | A | | 1/1989 | Regan |
| 4,796,807 | A | | 1/1989 | Bendig et al. |
| 4,833,014 | A | | 5/1989 | Linder et al. |
| 4,834,124 | A | | 5/1989 | Honda |
| 4,841,976 | A | | 6/1989 | Packard et al. |
| 4,850,534 | A | | 7/1989 | Takahashi et al. |
| 4,867,173 | A | | 9/1989 | Leoni et al. |
| 4,876,126 | A | | 10/1989 | Takemura et al. |
| 4,877,989 | A | | 10/1989 | Drews et al. |
| 4,884,579 | A | | 12/1989 | Engelson |
| 4,923,464 | A | | 5/1990 | Di Pisa, Jr. |
| 4,925,698 | A | | 5/1990 | Klausner et al. |
| 4,943,460 | A | | 7/1990 | Markle et al. |
| 4,945,937 | A | | 8/1990 | Scribner |
| 4,959,074 | A | | 9/1990 | Halpern et al. |
| 4,964,409 | A | | 10/1990 | Tremulis |
| 4,969,890 | A | | 11/1990 | Sugita et al. |
| 4,980,231 | A | | 12/1990 | Baker et al. |
| 4,995,367 | A | | 2/1991 | Yamauchi et al. |
| 5,002,582 | A | | 3/1991 | Guire et al. |
| 5,007,928 | A | | 4/1991 | Okamura et al. |
| 5,008,363 | A | | 4/1991 | Mallon et al. |
| 5,017,383 | A | | 5/1991 | Ozawa et al. |
| 5,019,400 | A | | 5/1991 | Gombotz et al. |
| 5,025,766 | A | | 6/1991 | Yamauchi et al. |
| 5,026,607 | A | | 6/1991 | Kiezulas |
| 5,037,656 | A | | 8/1991 | Pitt et al. |
| 5,037,677 | A | | 8/1991 | Halpern et al. |
| 5,040,543 | A | | 8/1991 | Badera et al. |
| 5,049,403 | A | | 9/1991 | Larm et al. |
| 5,057,371 | A | | 10/1991 | Cantry et al. |
| 5,066,705 | A | | 11/1991 | Wickert |
| 5,067,489 | A | | 11/1991 | Lind |
| 5,069,217 | A | | 12/1991 | Fleischhacker, Jr. |
| 5,069,226 | A | | 12/1991 | Yamauchi et al. |
| 5,076,266 | A | | 12/1991 | Babaev |
| 5,079,093 | A | | 1/1992 | Akashi et al. |
| 5,080,683 | A | | 1/1992 | Sulc et al. |
| 5,080,924 | A | | 1/1992 | Kamel et al. |
| 5,084,315 | A | | 1/1992 | Karimi et al. |
| 5,091,205 | A | | 2/1992 | Fan |
| 5,099,815 | A | | 3/1992 | Yamauchi et al. |
| 5,100,669 | A | | 3/1992 | Hyon et al. |
| 5,102,401 | A | | 4/1992 | Lambert et al. |
| 5,102,402 | A | | 4/1992 | Dror et al. |
| 5,102,417 | A | | 4/1992 | Palmaz |
| 5,105,010 | A | | 4/1992 | Sundaearaman et al. |
| 5,107,852 | A | | 4/1992 | Davidson et al. |
| 5,128,170 | A | | 7/1992 | Matsuda et al. |
| 5,134,993 | A | | 8/1992 | Van der Linden et al. |
| 5,147,370 | A | | 9/1992 | McNamara et al. |
| 5,160,790 | A | | 11/1992 | Elton |
| 5,211,183 | A | | 5/1993 | Wilson |
| 5,213,111 | A | | 5/1993 | Cook et al. |
| 5,217,026 | A | | 6/1993 | Stoy et al. |
| 5,234,457 | A | | 8/1993 | Andersen |
| 5,240,994 | A | | 8/1993 | Brink et al. |
| 5,241,970 | A | | 9/1993 | Johlin, Jr. et al. |
| 5,243,996 | A | | 9/1993 | Hall |
| 5,250,613 | A | | 10/1993 | Bergstrom et al. |
| 5,266,359 | A | | 11/1993 | Spielvogel |
| 5,275,173 | A | | 1/1994 | Samson et al. |
| 5,282,823 | A | | 2/1994 | Schwartz et al. |
| 5,283,063 | A | | 2/1994 | Freeman |
| 5,290,585 | A | | 3/1994 | Elton |
| 5,304,121 | A | | 4/1994 | Sahatjian |
| 5,304,140 | A | | 4/1994 | Kugo et al. |
| 5,315,998 | A | | 5/1994 | Tachibana et al. |
| 5,326,164 | A | | 7/1994 | Logan |
| 5,336,534 | A | | 8/1994 | Nakajima et al. |
| 5,344,426 | A | | 9/1994 | Lau et al. |
| 5,370,614 | A | | 12/1994 | Amundson et al. |
| 5,380,299 | A | | 1/1995 | Fearnot et al. |
| 5,389,379 | A | | 2/1995 | Dirix et al. |
| 5,419,760 | A | | 5/1995 | Narciso, Jr. |
| 5,426,885 | A | | 6/1995 | Williams |
| 5,443,458 | A | | 8/1995 | Eury |
| 5,443,496 | A | | 8/1995 | Schwartz et al. |
| 5,447,724 | A | | 9/1995 | Helmus et al. |
| 5,449,372 | A | | 9/1995 | Schmaltz et al. |
| 5,449,382 | A | | 9/1995 | Dayton |
| 5,464,650 | A | | 11/1995 | Berg et al. |
| 5,470,829 | A | | 11/1995 | Prisell et al. |
| 5,476,909 | A | | 12/1995 | Kim et al. |
| 5,512,055 | A | | 4/1996 | Domb et al. |
| 5,514,154 | A | | 5/1996 | Lau et al. |
| 5,515,841 | A | | 5/1996 | Robertson et al. |
| 5,515,842 | A | | 5/1996 | Ramseyer et al. |
| 5,516,043 | A | | 5/1996 | Manna et al. |
| 5,527,337 | A | | 6/1996 | Stack et al. |
| 5,529,635 | A | | 6/1996 | Odell |
| 5,545,208 | A | | 8/1996 | Wolff et al. |
| 5,548,035 | A | | 8/1996 | Kim et al. |
| 5,551,416 | A | | 9/1996 | Stimpson et al. |
| 5,562,922 | A | | 10/1996 | Lambert |
| 5,569,463 | A | | 10/1996 | Helmus et al. |
| 5,576,072 | A | | 11/1996 | Hostettler et al. |
| 5,578,075 | A | | 11/1996 | Dayton |
| 5,591,227 | A | | 1/1997 | Dinh et al. |
| 5,597,292 | A | | 1/1997 | Rhee et al. |
| 5,605,696 | A | | 2/1997 | Eury et al. |
| 5,609,629 | A | | 3/1997 | Fearnot et al. |
| 5,616,608 | A | | 4/1997 | Kinsella et al. |
| 5,620,738 | A | | 4/1997 | Fan et al. |
| 5,624,411 | A | | 4/1997 | Tuch |
| 5,626,862 | A | | 5/1997 | Brem et al. |
| 5,637,113 | A | | 6/1997 | Tartaglia et al. |
| 5,656,036 | A | | 8/1997 | Palmaz |
| 5,674,192 | A | | 10/1997 | Sahatjian et al. |
| 5,674,241 | A | | 10/1997 | Bley et al. |
| 5,674,242 | A | | 10/1997 | Phan et al. |
| 5,679,400 | A | | 10/1997 | Tuch |

5,697,967 A 12/1997 Dinh et al.
5,700,286 A 12/1997 Tartaglia et al.
5,702,754 A 12/1997 Zhong
5,709,874 A 1/1998 Hanson et al.
5,712,326 A 1/1998 Jones et al.
5,716,981 A 2/1998 Hunter et al.
5,733,925 A 3/1998 Kunz et al.
5,736,100 A 4/1998 Miyake et al.
5,739,237 A 4/1998 Russell et al.
5,755,769 A 5/1998 Richard et al.
5,776,184 A 7/1998 Tuch
5,785,972 A 7/1998 Tyler
5,799,732 A 9/1998 Gonzalez et al.
5,803,106 A 9/1998 Cohen et al.
5,837,008 A 11/1998 Berg et al.
5,868,153 A 2/1999 Cohen et al.
5,902,332 A 5/1999 Schatz
5,957,975 A 9/1999 Lafont et al.
5,972,027 A 10/1999 Johnson
6,041,253 A 3/2000 Kost et al.
6,053,424 A 4/2000 Gipson et al.
6,077,543 A 6/2000 Gordon et al.
6,099,561 A 8/2000 Alt
6,099,562 A 8/2000 Ding et al.
6,099,563 A 8/2000 Zhong
6,102,298 A 8/2000 Bush
6,104,952 A 8/2000 Tu et al.
6,120,536 A 9/2000 Ding et al.
6,190,315 B1 2/2001 Kost et al.
6,231,600 B1 5/2001 Zhong
6,234,765 B1 5/2001 Deak
6,234,990 B1 5/2001 Rowe et al.
6,244,738 B1 6/2001 Yasuda et al.
6,251,099 B1 6/2001 Kollias et al.
6,258,121 B1 7/2001 Yang et al.
6,287,285 B1 9/2001 Michael et al.
6,296,630 B1 10/2001 Altman et al.
6,299,604 B1 10/2001 Ragheb et al.
6,306,166 B1 10/2001 Barry et al.
6,315,215 B1 11/2001 Gipson et al.
6,335,029 B1 1/2002 Kamath et al.
6,357,671 B1 3/2002 Cewers
6,369,039 B1 4/2002 Palasis et al.
6,450,417 B1 9/2002 Gipson et al.
6,478,754 B1 11/2002 Babaev
6,560,548 B1 5/2003 Roudil et al.
6,568,052 B1 5/2003 Rife et al.
6,569,099 B1 5/2003 Babaev
6,601,581 B1 8/2003 Babaev
6,663,554 B2 12/2003 Babaev
6,706,288 B2 3/2004 Gustavsson et al.
6,720,710 B1 4/2004 Wenzel et al.
6,723,064 B2 4/2004 Babaev
6,730,349 B2 5/2004 Schwarz
6,737,021 B2 5/2004 Watari et al.
6,776,352 B2 8/2004 Jameson
6,811,805 B2 11/2004 Gilliard et al.
6,837,445 B1 1/2005 Tsai
6,840,280 B1 1/2005 Simon
6,861,088 B2 3/2005 Weber et al.
6,883,729 B2 4/2005 Putvinski et al.
7,044,163 B1 5/2006 Fan et al.
7,060,319 B2 6/2006 Fredrickson
7,077,860 B2 7/2006 Yan et al.
7,178,554 B2 2/2007 Tanner, et al
2002/0127346 A1 9/2002 Heber
2003/0098364 A1 5/2003 Jameson
2003/0223886 A1 12/2003 Keilman
2004/0039375 A1 2/2004 Miyazawa
2004/0045547 A1 3/2004 Yamamoto et al.
2004/0191405 A1 9/2004 Kerrigan
2004/0197585 A1 10/2004 Hughes et al.
2004/0204680 A1 10/2004 Lal et al.
2004/0204750 A1 10/2004 Dinh
2004/0211362 A1 10/2004 Castro et al.
2004/0215313 A1 10/2004 Cheng
2004/0215336 A1 10/2004 Udipi et al.
2004/0220610 A1 11/2004 Kreidler et al.
2004/0224001 A1 11/2004 Pacetti et al.
2004/0234748 A1 11/2004 Stenzel
2004/0236399 A1 11/2004 Sundar
2004/0249449 A1 12/2004 Shanley et al.
2005/0043788 A1 2/2005 Luo et al.
2005/0058768 A1 3/2005 Teichman
2005/0064088 A1 3/2005 Fredrickson
2005/0070936 A1 3/2005 Pacetti
2005/0070997 A1 3/2005 Thornton et al.
2007/0051307 A1 3/2007 Babaev
2007/0295832 A1 12/2007 Gibson et al.
2008/0006714 A1 1/2008 McNichols et al.

* cited by examiner

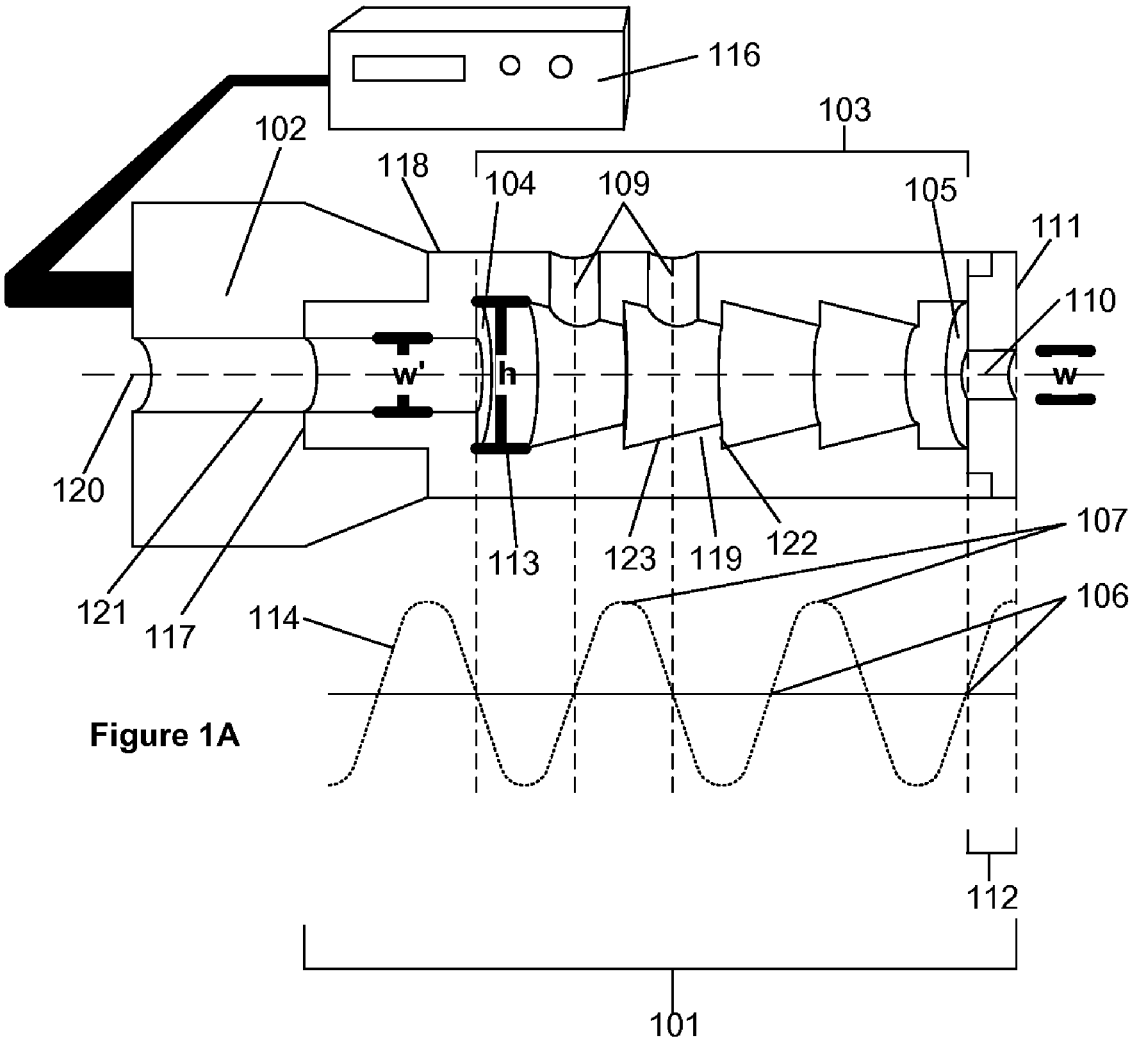
Figure 1A
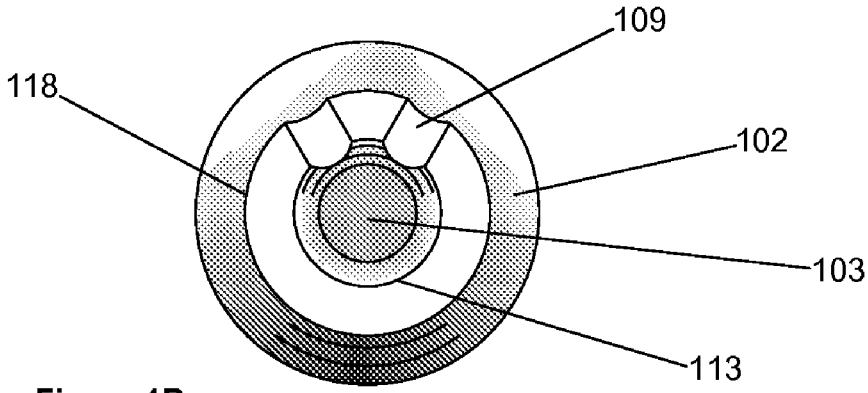
Figure 1B
FIGURE 1

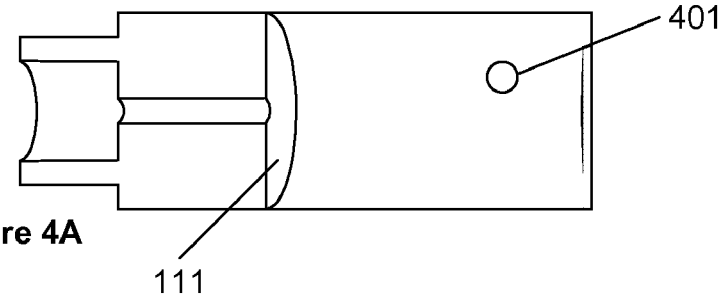
Figure 4A
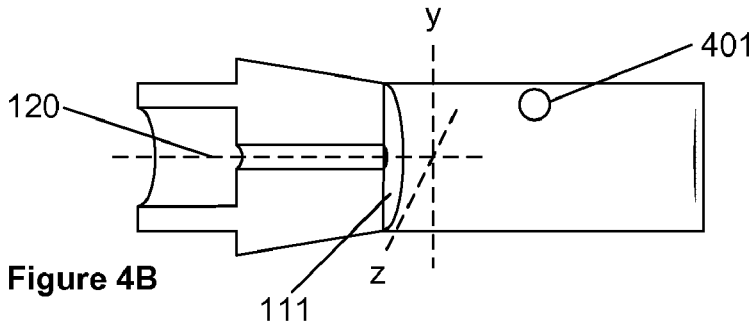
Figure 4B
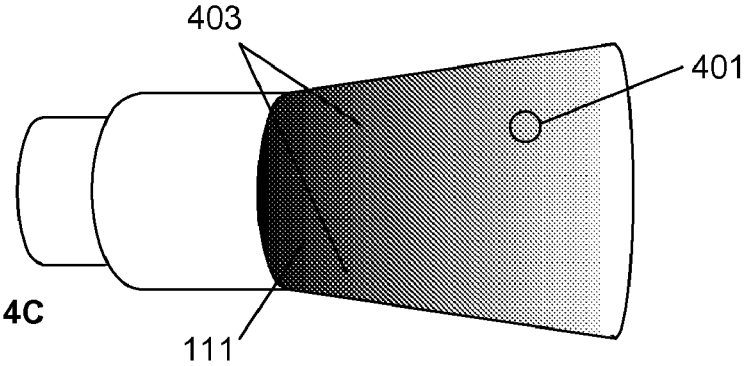
Figure 4C
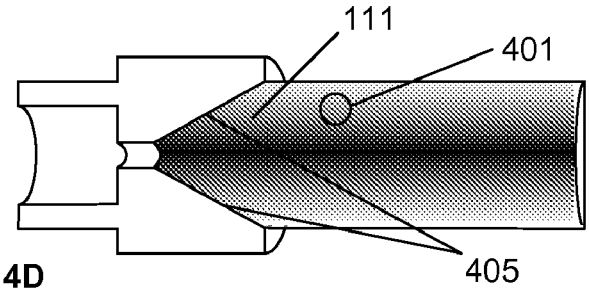
Figure 4D
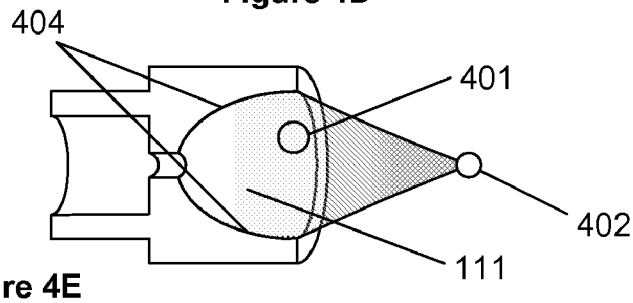
Figure 4E
Figure 4

ULTRASOUND PUMPING APPARATUS

BACKGROUND OF THE INVENTION

1. Field of the Invention

The present invention relates to an apparatus utilizing ultrasonic vibrations forcing the movement of pumping members or protrusions to spray fluid from an internal chamber of the device.

2. Background of the Related Art

Numerous ultrasonic devices exist for the purpose of delivering atomized liquids to high pressure environments, such as internal combustion engines. For example, ultrasonic fuel injectors containing internal chambers have been developed and disclosed in U.S. Pat. No. 4,469,974, to Speranza, U.S. Pat. No. 4,995,367, to Yamauchi et al., and U.S. Pat. No. 5,025,766, to Yamauchi et al. These devices atomize liquids upon expulsion from the tip of the device. The tip is ultrasonically vibrated and upon collision with the fluid, drives atomization by breaking down the liquid into small droplets.

SUMMARY OF THE INVENTION

The present invention relates to an apparatus utilizing ultrasonic vibrations to force the movement of protrusions to spray fluids. The apparatus comprises a horn with an internal chamber possessing a front wall, a back wall, and at least one side wall. Within the internal chamber of the horn are protrusions extending from a wall of the chamber. The horn includes a radiation surface at its distal end. Fluids to be expelled from the horn enter the internal chamber of the horn through at least one channel passing through a wall of the horn and leading into the chamber. After passing through the horn's internal chamber, the fluids exit the horn by passing through a channel originating in the front wall of the chamber and ending at the radiation surface. A transducer may be connected to the horn's proximal end to generate ultrasonic vibrations throughout the length of the horn.

Typical pressure-driven fluid atomizers function in the following way: As the fluid to be atomized passes through a constriction, the net pressure pushing the fluid through the constriction is converted to kinetic energy. As a result of the conversion, the velocity of the fluid increases, while the pressure of the fluid decreases. The increase in kinetic energy breaks the attractive forces between the molecules of the fluid, resulting in atomization of the fluid. However, concerning traditional atomizers, fluid atomization is hindered by high-pressure environments. This is because the high pressure in the environment pushes the fluid back into the spraying apparatus. The difference between the internal pressure pushing the fluid forward and out of the spraying apparatus and the environmental pressure pushing the fluid back into the spraying apparatus is called the net pressure. Net pressure is converted to kinetic energy. If there is an increase in environmental pressure, the net pressure decreases, resulting in decreased kinetic energy. In turn, the decrease in kinetic energy decreases atomization. The present invention offers a possible resolution to this industry-wide problem by coupling ultrasonic energy to a spraying apparatus to atomize and/or expel fluids out into environments of high pressure.

The present invention couples ultrasonic vibrations to a series of pumping members or protrusions to produce a spraying apparatus. As the transducer transmits ultrasonic vibrations throughout the horn, the horn is activated. The ultrasonic vibrations traveling through the horn cause segments of the horn to expand and contract. The segments of the horn corresponding with regions between nodes (points of minimum deflection or amplitude) on the ultrasonic vibrations expand and contract. Furthermore, segments of the horn corresponding with points of anti-nodes on the ultrasonic vibrations exhibit the greatest amount of movement, as anti-nodes are points of maximum deflection or amplitude. Conversely, segments of the horn corresponding exactly with nodes on ultrasonic vibrations do not expand or contract.

As segments of the horn are expanding and contracting, the protrusions which extend from those segments of the chamber's walls, also contract and expand. This causes a pumping motion as the front-facing edges of the protrusions move forward, increasing the fluid pressure and driving the fluids forward. Therefore, by increasing the pressure pushing the fluids out, the kinetic energy of the fluids increases, thereby enabling the device to overcome environmental pressure working to push the fluid back in.

To efficiently and effectively push fluids forward through the chamber and out the radiation surface, the rear-facing edges of the protrusions should be more streamlined than their front-facing edges. This configuration enables the net movement of the fluids (fluid pushing forward minus fluid pushing backwards) in the forward direction.

It is preferred to orient the front-facing edges of the protrusions approximately perpendicular to the central axis of the horn. A front-facing edge that is approximately perpendicular to the central axis acts more like a wall pushing the fluid forward when the protrusion expands. When the protrusion contracts, the rear-facing edges, which are not approximately perpendicular to the central axis, may be more streamlined and, therefore, may not effectively push the fluids backwards.

It is also preferred to locate the front-facing edges of the protrusions on anti-nodes of the ultrasonic vibrations passing through the horn. So locating the front-facing edges enables the pumping action produced by vibrating the horn to be controlled by the frequency of the vibrations. For example, if the frequency of the ultrasonic vibrations were cut in half, then some of the front-facing edges would fall on nodes (points of no movement) of the ultrasonic vibrations. This would prevent those protrusions from pumping fluids and overall, reduce the pumping action of the horn. Therefore, the pumping mechanism may be controlled by adjusting the frequency of the ultrasonic vibrations passing through the horn.

An important aspect of the spraying apparatus involves the relationship between the amplitude of the ultrasonic vibrations passing through the horn and the pumping behavior of the protrusions. Increasing the amplitude of the ultrasonic vibrations passing through the horn increases the degree of deflection the ultrasonic vibrations create. Therefore, the higher the amplitude of the ultrasonic vibrations passing through the horn the farther forward the protrusions will move. Consequently, increasing the amplitude will increase the amount of pumping produced by the protrusions. Increased pumping by the protrusions increases the pressure generated by the protrusion' motion. If the horn is vibrated in resonance by a piezoelectric transducer driven by an electrical signal supplied by a generator, then the amplitude of the vibrations passing through the horn can be increased by increasing the voltage of the electrical signal driving the transducer.

Increasing the amplitude of the ultrasonic vibrations increases the amount of kinetic energy imparted on fluids as they exit the horn at the radiation surface. As discussed above, increased amplitude causes increased deflection of the ultrasonic vibrations. The increased deflection causes increased pumping of the protrusions, resulting in an increase in pressure of the fluids being pumped through the spraying apparatus. The increased pressure causes increased kinetic energy which is imparted on the fluids movement out of the chamber. Therefore, the atomization occurring as the fluid exits at the radiation surface may be manipulated by adjusting the amplitude of the ultrasonic vibrations.

The protrusions may be discrete elements such as, but not limited to, discrete bands encircling the internal chamber of the ultrasound tip. The protrusions may also spiral down the chamber similar to the threading in a nut. However, the protrusions need not encircle the entire circumference of the chamber.

Protrusions may take the form of various shapes such as, but not limited to, convex, spherical, triangular, polygonal, teeth-like, and/or any combination thereof so long as enough of the protrusions contain a front-facing edge less streamlined than their corresponding rear-facing edge, as to generate a net forward movement of the fluid passing through the internal chamber of the horn. Depending upon the chosen conformation of the protrusions, the front-facing edges of the protrusions may not need to be orientated approximately perpendicular to the central axis of the horn. Likewise, depending upon the conformation chosen, it may be possible to orient the rear-facing edges of the protrusions approximately perpendicular to the central axis of the horn.

It is preferable to position the back and front walls of the chamber on nodes of the ultrasonic vibrations. Positioning the back and front walls on nodes minimizes the amount of ultrasonic vibrations emanating into the chamber from the back wall and the amount of ultrasonic vibrations reflecting back into the chamber off the front wall. This is significant because the ultrasonic vibrations reflecting off the front wall push the fluids back into the chamber. However, this is only a suggested preference since the walls of the chamber may be positioned on any point along the ultrasound vibrations.

The front wall of the chamber may contain slanted portions. A front wall with slanted portions serves to funnel fluids to be atomized and/or expelled into the channel leading to the radiation surface. This results in a more efficient system of delivering fluid to the radiation surface for expulsion.

As already discussed, the ultrasound horn may serve to atomize liquids. Atomization is a process by which bulk liquids are converted to a collection of drops such as a mist and/or spray. The present invention couples kinetic energy to drive atomization. If the channel running from the chamber to the radiation surface is narrower than the width of the chamber, the fluid's velocity increases as it passes from the chamber into the channel with a simultaneous decrease in pressure. As explained above, an increase in velocity is proportional to an increase in kinetic energy. The kinetic energy drives atomization as it breaks the attractive forces between molecules in the fluid.

As the fluid exits the horn at the radiation surface, it may be atomized by the ultrasonic vibrations emanating from the radiation surface. The ultrasonic vibrations traveling through the horn cause the radiation surface to move forward. The radiation surface's movement causes a collision with the fluid exiting the horn and the surrounding air. This collision causes the radiation surface to release vibrations into the exiting fluid. As such, the kinetic energy of the exiting fluid increases. The increased kinetic energy enhances atomization of the fluid exiting at the radiation surface, thereby counteracting a decrease in atomization caused by changing environmental conditions. If the fluid is atomized by its passage through the horn, the ultrasonic vibrations emanating from the radiation surface may serve to further atomize the fluid as it is expelled at the radiation surface, by breaking the already internally-atomized fluid into even smaller droplets.

Adjusting the amplitude of the ultrasonic waves traveling down the length of the horn may also be useful in focusing the atomized spray produced at the radiation surface. Creating a focused spray may be accomplished by utilizing the ultrasonic vibrations emanating from the radiation surface to confine and direct the spray pattern. Ultrasonic vibrations emanating from the radiation surface may direct and confine the vast majority of the atomized spray produced within the outer boundaries of the radiation surface. The level of confinement obtained by the ultrasonic vibrations emanating from the radiation surface depends upon the amplitude of the ultrasonic vibrations traveling down the horn. As such, increasing the amplitude of the ultrasonic vibrations passing through the horn may narrow the width of the spray pattern produced, thereby focusing the spray. For instance, if the spray is fanning too wide, increasing the amplitude of the ultrasonic vibrations may narrow the spray pattern. Conversely, if the spray is too narrow, then decreasing the amplitude of the ultrasonic vibrations may widen the spray pattern.

As the atomized fluid is expelled from the radiation surface, the spray produced may be altered depending on the geometric conformation of the radiation surface. A radiation surface with a planar face produces a roughly column-like spray pattern. A tapered radiation surface generates a narrower spray pattern as compared to the width of the horn. A concave radiation surface focuses the spray whereas a convex radiation surface produces a spray wider than the width of the horn. Furthermore, the radiation surface may contain slanted portions, resulting in an inward spray directed towards the central axis of the horn. Any combination of the above mentioned configurations may be used such as, but not limited to, an outer concave portion encircling an inner convex portion and/or an outer planer portion encompassing an inner conical portion. Inducing the horn to vibration in resonance may facilitate the production of the spray patterns described above, but may not be necessary.

It should be noted and appreciated that other features and advantages, in addition to those listed, may be elicited by devices in accordance with the present invention. The mechanisms of operation presented herein are strictly theoretical and are not meant in any way to limit the scope this disclosure and/or the accompanying claims.

BRIEF DESCRIPTION OF THE DRAWINGS

The present invention will be shown and described with reference to the drawings of preferred embodiments and clearly understood in details.

FIG. 1 illustrates cross-sectional views of an embodiment of the ultrasonic spraying apparatus, including FIG. 1A which shows a longitudinal cross-section of the ultrasonic spraying apparatus and FIG. 1B which shows a cross-section of the spraying apparatus wherein fluid channels are located on the same platan.

FIG. 4 illustrates alternative embodiments of the radiation surface, including FIG. 4A which shows a radiation surface with a planar face, FIG. 4B which shows a radiation surface with a tapered planar face, FIG. 4C which shows a radiation surface having a convex portion, FIG. 4D which shows a radiation surface having a conical portion, and FIG. 4E which shows a radiation surface having a concave portion.

DESCRIPTION OF THE INVENTION

Figure 2:
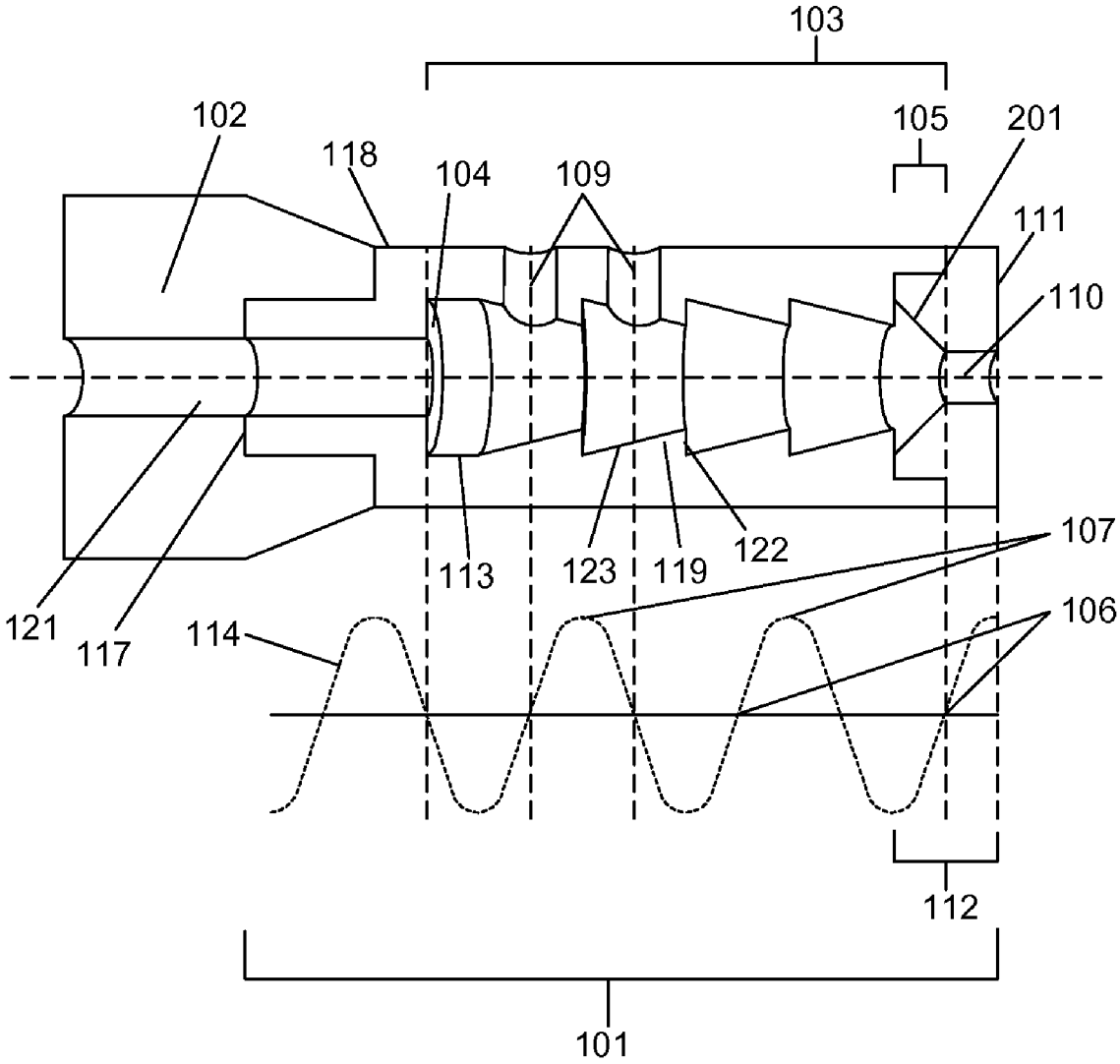
FIG. 2 illustrates a cross-sectional view of an alternative embodiment of the ultrasonic spraying apparatus containing a slanted portion within the front wall of the chamber.

Preferred embodiments of the ultrasonic spraying apparatus are illustrated throughout the figures and described in detail below. Those skilled in the art will understand the advantages provided by the ultrasonic spraying apparatus upon review.

FIG. 1 illustrates an embodiment of the ultrasonic spraying apparatus comprising a horn 101 and an ultrasound transducer 102 attached to the proximal surface 117 of horn 101 powered by generator 116. As ultrasound transducers and generators are well known in the art they need not and will not, for the sake of brevity, be described in detail herein. Horn 101 may be secured to transducer 102 by using a threaded mechanical connector, an adhesive attachment, and/or by welding transducer 102 to horn 101. Other manners of securing horn 101 to transducer 102, as to mechanically couple the two elements, may be equally effective and are readily recognizable to persons of ordinary skill in the art. Transducer 102 and horn 101 may also be a single piece.

Ultrasound horn 101 comprises a proximal surface 117, a radiation surface 111 opposite proximal surface 117, and at least one radial surface 118 extending between proximal surface 117 and radiation surface 111. Within horn 101 has an internal chamber 103 containing a back wall 104, a front wall 105, and at least one side wall 113 extending between back wall 104 and front wall 105. The back wall 104 and front wall 105 of internal chamber 103 lie approximately on nodes 106 of ultrasonic vibrations 114. This positioning of back wall 104 and front wall 105 reduces the amount of ultrasonic vibrations 114 within chamber 103. So positioning back wall 104 reduces its movement and collisions with the fluid within chamber 103, because nodes 106 are points on ultrasonic vibrations 114 of minimum deflection or amplitude. Similarly, positioning front wall 105 on a node reduces the echoing of ultrasonic vibrations off front wall 105. Although the preferred positions of front wall 105 and back wall 104 are approximately on nodes 106 of ultrasonic vibrations 114, front wall 105 and/or back wall 104 may be positioned at any point along ultrasonic vibrations 114, including anti-nodes 107.

Protrusions 119 extend from back wall 104 and continue along side walls 113. Protrusions 119 comprise front-facing edges 122 and rear-facing edges 123 more streamlined than their front-facing edges. Front-facing edges 122 of protrusions 119 are approximately perpendicular to central axis 120 of horn 101 and lie approximately on anti-nodes 107 of ultrasonic vibrations 114. Although it is preferable that at least one point on front-facing edges 122 lie approximately on an anti-node, the front-facing edges may be positioned at any point along ultrasonic vibrations 114. Furthermore, not all of the front-facing edges 122 need be located on corresponding points of ultrasonic vibrations 114.

The fluid to be atomized and/or expelled may enter internal chamber 103 through at least one channel 109 originating in radial surface 118. Channel 109 may lie approximately on a node 106 of ultrasonic vibrations 114. After entering chamber 103 through channel 109, the fluid exits chamber 103 through channel 110, originating in the front wall 105 of chamber 103 and ending at the radiation surface 111.

If fluid passing through horn 101 is to be atomized by the kinetic energy gained from its passage through channel 110, then the maximum height (h) of chamber 103 should be larger than maximum width (w) of channel 110. Preferably, the maximum height of chamber 103 should be approximately 200 times larger than the maximum width of channel 110 or greater.

FIG. IB illustrates an alternative embodiment of the ultrasonic spraying apparatus, viewed from the distal end of horn 101 and looking back towards the proximal end of horn 101, much like looking down a barrel of a gun. Channels 109 are located on the same platan but alternatively or in combination, channels may be located on different platans. Alternative embodiments of an ultrasound horn 101 in accordance with the present invention may possess a single channel 109 opening within side wall 113 of chamber 103. If multiple channels 109 are utilized, they may be aligned along the central axis 120 of horn 101, as depicted in FIG. 1A. When horn 101 includes multiple channels opening into chamber 103, atomization of the fluid may be improved be delivering a gas into chamber 103 through at least one of the channels.

Alternatively or in combination, the fluid to be atomized may enter chamber 103 through a channel 121 originating in proximal surface 117 and opening within back wall 104, as depicted in FIG. 1A. If the fluid expelled from horn 101 is to be atomized by its passage through horn 101, then the maximum width (w') of channel 121 should be smaller than the maximum height of chamber 103. Preferably, the maximum height of chamber 103 should be approximately twenty times larger than the maximum width of channel 121.

It is preferable if at least one point on radiation surface 111 lies approximately on an anti-node of the ultrasonic vibrations 114 passing through horn 101.

Ultrasound horn 101 may further comprise cap 112 attached to its distal end. Cap 112 may be mechanically attached (for example, secured with a threaded connector), adhesively attached, and/or welded to the distal end of horn 101. Other means of attaching cap 112 to horn 101, readily recognizable to persons of ordinary skill in the art, may be used in combination with or in the alternative to the previously enumerated means. Comprising front wall 105, channel 110, and radiation surface 111, a removable cap 112 permits the level of fluid atomization and/or the spray pattern produced to be adjusted depending on need and/or circumstances. For instance, the width of channel 110 may need to be adjusted to produce the desired level of atomization with different fluids. The geometrical configuration of the radiation surface may also need to be changed to create the appropriate spray pattern for different applications. Attaching cap 112 to the spraying apparatus approximately on a node 106 of ultrasonic vibrations 114 passing through horn 101 may help prevent the separation of cap 112 from horn 101 during operation.

It is important to note that fluids of different temperatures may be delivered into chamber 103 as to improve the atomization of the fluid exiting channel 110. This may also change the spray volume, the quality of the spray, and/or expedite the drying process of the fluid sprayed.

FIG. 2 illustrates a cross-sectional view of an alternative embodiment of ultrasound horn 101 further comprising slanted portion 201 within front wall 105 of chamber 103. Front wall 105 with slanted portion 201 serves to funnel the fluid to be expelled and/or atomized into channel 110 leading to radiation surface 111. This results in a more efficient system of delivering fluids to the radiation surface for expulsion.

Figure 6:
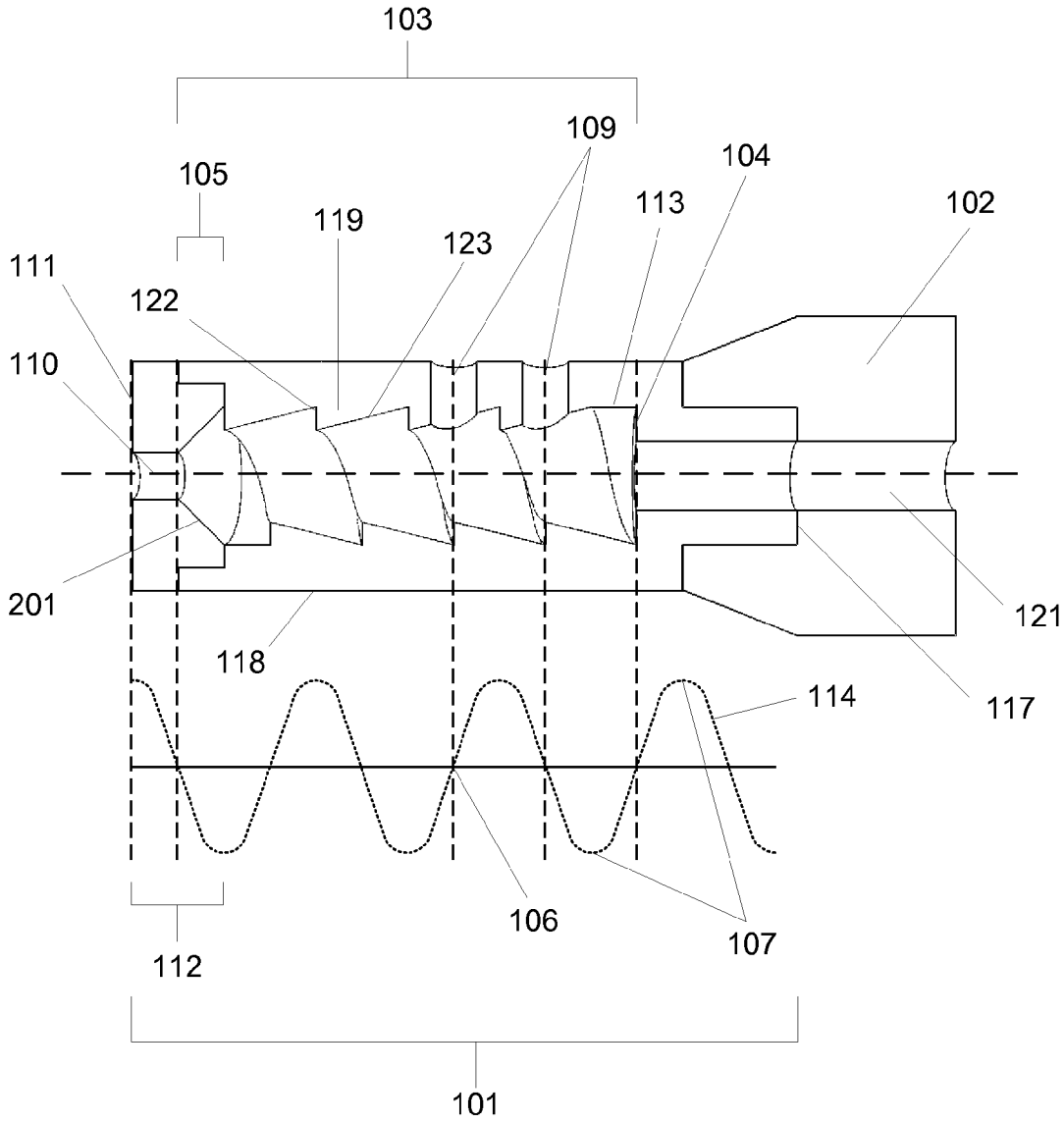
FIG. 6 illustrates an alternative embodiment of ultrasonic spraying apparatus depicted in FIG. 2 in which the protrusion is a discrete band spiraling down the chamber.

FIG. 6 illustrates a cross-sectional view of an alternative embodiment of ultrasound horn 101 depicted in FIG. 2 characterized by protrusion 119 being a discrete band spiraling down chamber 103 similar to the threading in a nut.

Figure 3:
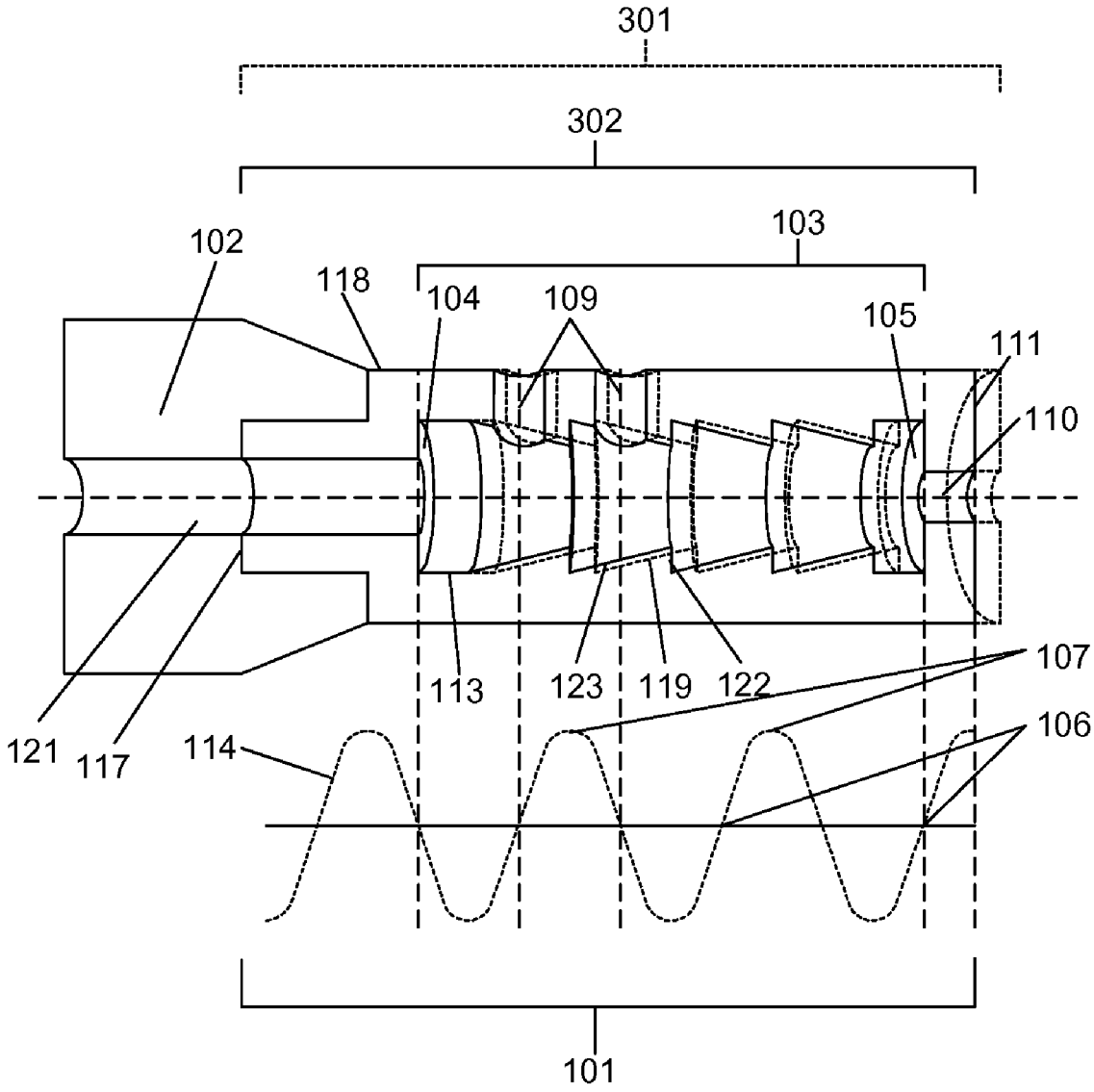
FIG. 3 illustrates a cross-sectional view of one embodiment of the ultrasonic spraying apparatus held stationary and in forward motion as depicted by the dotted lines.

FIG. 3 illustrates the embodiment of the ultrasonic spraying apparatus depicted in FIG. 1 in forward motion. As ultrasonic vibrations 114 travel from the proximal end of horn 101 to radiation surface 111 at the distal end of horn 101, segments of horn 101 expand and contract. Consequently, protrusions 119 expand and contract by moving forwards and backwards, causing the fluids within chamber 103 to be pumped towards radiation surface 111 through channel 110 leading out from internal chamber 103 to radiation surface 111. This forward position 301 of the ultrasonic spraying apparatus is depicted by dotted lines. As segments of horn 101 move backwards, horn 101 resumes its original stationary position 302 depicted by solid black lines. The pressure supplied by moving protrusions 119 forward may expel the fluid from horn 101 at radiation surface 111 and out into the environment with a pressure greater than the pressure at which the fluid is delivered into chamber 103. To maximize the effectiveness of the pumping action produced by protrusions 119 depicted in FIG. 3, the total area of all front-facing edges 122 approximately perpendicular to central axis 120 of horn 101 should be larger than the total area of all rear-facing edges approximately perpendicular to central axis 120 of horn 101.

Figure 5:
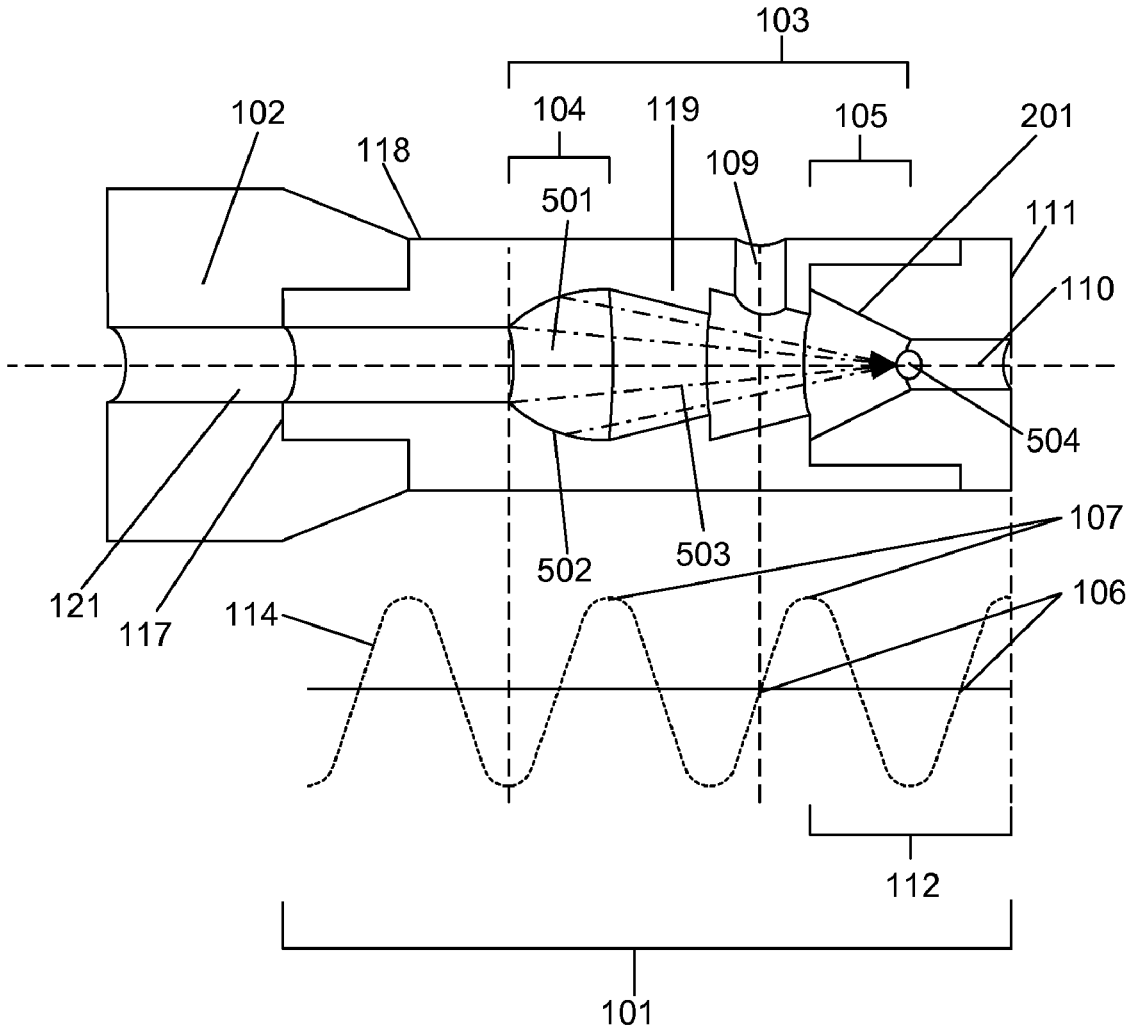
FIG. 5 illustrates an alternative embodiment of ultrasonic spraying apparatus containing an ultrasonic lens within the back wall of the chamber.

FIG. 5 illustrates an alternative embodiment of horn 101 further comprising a concave ultrasonic lens 501 within back wall 104. If the concave portion 502 of ultrasonic lens 501 forms an overall parabolic configuration in at least two dimensions, then the ultrasonic vibrations depicted by arrows 503 emanating from concave portion 502 of lens 501 travel in an undisturbed pattern of convergence towards the parabola's focus 504. As the ultrasonic vibrations 503 converge at focus 504, the fluid within chamber 103 is carried by vibrations 503 towards focus 504. The fluid passing through chamber 103 is therefore directed towards focus 504. Positioning focus 504 at or near the opening of channel 110, as to be in close proximity to the opening of channel 110 in front wall 105, consequently, may facilitate the fluid's entry into channel 110. Thus, placing a concave lens with back wall 104 may increase the pumping action of horn 101.

Positioning back wall 104 such that at least one point on lens 501 lies approximately on an anti-node of the ultrasonic vibrations 114 passing through horn 101 may maximize the increased pumping action produced by lens 501. Preferably, the center of lens 501 lies approximately on an anti-node of the ultrasonic vibrations 114. It may also be desirable for slanted portion 201 of front wall 105 to form an angle equal to or greater than the angle of convergence of the ultrasonic vibrations emitted from the peripheral boundaries of ultrasonic lens 501.

Ultrasonic vibrations emanating from radiation surface 111 spray the fluid ejected at radiation surface 111. The manner in which ultrasonic vibrations emanating from the radiation surface direct the spray of fluids ejected from channel 110 depends largely upon the conformation of radiation surface 111. FIG. 4 illustrates alternative embodiments of the radiation surface. FIGS. 4A and 4B depict radiation surfaces 111 comprising a planar face producing a roughly column-like spray pattern. Radiation surface 111 may be tapered such that it is narrower than the width of the horn in at least one dimension oriented orthogonal to the central axis 120 of the horn, as depicted FIG. 4B. Ultrasonic vibrations emanating from the radiation surfaces 111 depicted in FIGS. 4A and 4B may direct and confine the vast majority of spray 401 ejected from channel 110 to the outer boundaries of the radiation surfaces 111. Consequently, the majority of spray 401 emitted from channel 110 in FIGS. 4A and 4B is initially confined to the geometric boundaries of the respective radiation surfaces.

The ultrasonic vibrations emitted from the convex portion 403 of the radiation surface 111 depicted in FIG. 4C directs spray 401 radially and longitudinally away from radiation surface 111. Conversely, the ultrasonic vibrations emanating from the concave portion 404 of the radiation surface 111 depicted in FIG. 4E focuses spray 401 through focus 402. Maximizing the focusing of spray 401 towards focus 402 may be accomplished by constructing radiation surface 111 such that focus 402 is the focus of an overall parabolic configuration formed in at least two dimensions by concave portion 404. The radiation surface 111 may also possess a conical portion 405 as depicted in FIG. 4D. Ultrasonic vibrations emanating from the conical portion 405 direct the atomized spray 401 inwards. The radiation surface may possess any combination of the above mentioned configurations such as, but not limited to, an outer concave portion encircling an inner convex portion and/or an outer planar portion encompassing an inner conical portion.

The horn may be capable of vibrating in resonance at a frequency of approximately 16 kHz or greater. The ultrasonic vibrations traveling down the horn may have an amplitude of approximately 1 micron or greater. It is preferred that the horn be capable of vibrating in resonance at a frequency between approximately 20 kHz and approximately 200 kHz. It is recommended that the horn be capable of vibrating in resonance at a frequency of approximately 30 kHz.

The signal driving the ultrasound transducer may be a sinusoidal wave, square wave, triangular wave, trapezoidal wave, or any combination thereof.

It should be appreciated that elements described with singular articles such as "a", "an", and/or "the" and/or otherwise described singularly may be used in plurality. It should also be appreciated that elements described in plurality may be used singularly.

Although specific embodiments of apparatuses and methods have been illustrated and described herein, it will be appreciated by those of ordinary skill in the art that any arrangement, combination, and/or sequence that is calculated to achieve the same purpose may be substituted for the specific embodiments shown. It is to be understood that the above description is intended to be illustrative and not restrictive. Combinations of the above embodiments and other embodiments as well as combinations and sequences of the above methods and other methods of use will be apparent to individuals possessing skill in the art upon review of the present disclosure.

The scope of the claimed apparatus and methods should be determined with reference to the appended claims, along with the full scope of equivalents to which such claims are entitled.

I claim:

1. An apparatus comprising:

a. a proximal surface opposite a distal end;

b. a radiation surface located on the distal end;

c. a proximal end opposite the distal end and a central axis extending from the proximal end to the radiation surface;

d. an internal chamber comprised of:

i. a back wall, ii. a front wall, and iii. at least one side wall extending between the back wall and the front wall, e. a channel originating in the front wall of the chamber and ending at the radiation surface;

f. at least one channel originating in a surface other than the radiation surface and opening into the chamber; and g. at least one protrusion extending from the side wall into the chamber containing at least one front-facing edge and a rear-facing edge more streamlined than the front-facing edge.

2. The apparatus according to claim 1 further comprising at least one slanted portion within the front wall.

3. The apparatus according to claim 1 characterized by the at least one of the at least one protrusion being a discrete band encircling the chamber.

4. The apparatus according to claim 1 characterized by the at least one of the at least one protrusion being a discrete band spiraling down the chamber.

5. The apparatus according to claim 1 characterized by the channel originating in the front wall of the chamber having a maximum width smaller than the maximum height of the chamber.

6. The apparatus according to claim 1 characterized by the maximum height of the internal chamber being approximately 200 times larger than the maximum width of the channel originating in the front wall of the internal chamber or greater.

7. The apparatus according to claim 1 characterized by the channel opening into the chamber originating in the proximal surface and opening into the back wall and having a maximum width smaller than the maximum height of the chamber.

8. The apparatus according to claim 1 characterized by the channel opening into the chamber originating in the proximal surface and opening into the back wall of the internal chamber and the maximum height of the internal chamber being approximately 20 times larger than the maximum width of the channel or greater.

9. The apparatus according to claim 1 further comprising an ultrasonic lens with one or a plurality of concave portions that form an overall parabolic configuration in at least two dimensions within the back wall.

10. The apparatus according to claim 9 characterized by the focus of the parabola formed by the concave portion or portions of the ultrasonic lens lying in proximity to the opening of the channel originating within the front wall of the internal chamber.

11. The apparatus according to claim 1 further comprising a planar portion within the radiation surface.

12. The apparatus according to claim 1 further comprising a planar portion within the radiation surface narrower than the width of the apparatus in at least one dimension oriented orthogonal to the central axis.

13. The apparatus according to claim 1 further comprising at least one concave portion within the radiation surface.

14. The apparatus according to claim 1 further comprising at least one convex portion within the radiation surface.

15. The apparatus according to claim 1 further comprising at least one conical portion within the radiation surface.

16. The apparatus according to claim 1 further comprising a transducer attached to the proximal surface capable of inducing the apparatus of claim 1 to vibrate in resonance at a frequency of approximately 16 kHz or greater.

17. The apparatus according to claim 16 further comprising a generator driving the transducer.

18. An apparatus characterized by:

a. a proximal end opposite a distal end;

b. a radiation surface located on the distal end;

c. a central axis extending from the proximal end to the radiation surface;

d. an internal chamber comprised of:

i. a back wall, ii. a front wall, and iii. at least one side wall extending between the back wall and the front wall, e. a channel originating in the front wall of the chamber and ending at the radiation surface;

f. at least one channel originating in a surface other than the radiation surface and opening into the chamber;

g. at least one protrusion extending from the side wall into the chamber containing at least one front-facing edge and a rear-facing edge more streamlined than the front-facing edge; and h. being capable of vibrating in resonance at a frequency of approximately 16 kHz or greater.

19. The apparatus according to claim 18 further characterized by the channel opening into the chamber originating in a radial surface and opening into a side wall of the chamber and lying approximately on a node of the ultrasonic vibrations.

20. The apparatus according to claim 18 further characterized by at least one point on the back wall lying approximately on a node of the ultrasonic vibrations.

21. The apparatus according to claim 18 further characterized by at least one point on the front wall lying approximately on a node of the ultrasonic vibrations.

22. The apparatus according to claim 18 further characterized by at least one point on a front-facing edge of at least one protrusion lying approximately on an antinode of the ultrasonic vibrations.

23. The apparatus according the claim 22 further characterized by at least on point on the radiation surface lying approximately an anti-node of the ultrasonic vibrations.

* * * * *